US010309680B2

(12) United States Patent
Ling et al.

(10) Patent No.: US 10,309,680 B2
(45) Date of Patent: Jun. 4, 2019

(54) THERMAL BREAK AIR-CONDITIONER TANK

(71) Applicants: Johnson Controls Technology Company, Plymouth, MI (US); York Guangzhou Air Conditioning and Refrigeration Co., Ltd., Quingyuan (CN)

(72) Inventors: Zhifeng Ling, Wuxi (CN); Zhenggang Cao, Wuxi (CN)

(73) Assignees: Johnson Controls Technology Company, Auburn Hills, MI (US); York Guangzhou Air Conditioning and Refrigeration Co., Ltd., Quingyuan, Guangdong (CN)

( * ) Notice: Subject to any disclaimer, the term of this patent is extended or adjusted under 35 U.S.C. 154(b) by 0 days.

(21) Appl. No.: 15/608,768

(22) Filed: May 30, 2017

(65) Prior Publication Data

US 2017/0343233 A1 Nov. 30, 2017

(30) Foreign Application Priority Data

May 31, 2016 (CN) ..... 2016 2 0519850 U

(51) Int. Cl.
*F24F 13/02* (2006.01)

(52) U.S. Cl.
CPC ..... *F24F 13/0209* (2013.01); *F24F 13/0263* (2013.01)

(58) Field of Classification Search
CPC ..... F24F 13/0209; F24F 13/0263
USPC ..... 248/637, 676, 644; 211/182, 189; 312/265.4, 257.1
See application file for complete search history.

(56) References Cited

U.S. PATENT DOCUMENTS 2,956,705 A * 10/1960 Clingman ..... A47B 47/0008 217/12 R
4,691,970 A * 9/1987 Neri ..... A47B 47/0008 312/140
4,782,637 A * 11/1988 Eriksson ..... E04B 1/3483 312/111
4,968,105 A * 11/1990 Schaars ..... A47B 47/0008 312/140
5,219,403 A * 6/1993 Murphy ..... F16L 9/003 137/561 A
5,870,868 A * 2/1999 Kita ..... E04C 2/384 312/140

(Continued)

*Primary Examiner* — Muhammad Ijaz
(74) *Attorney, Agent, or Firm* — Fletcher Yoder, P.C.

(57) ABSTRACT

The present invention relates to a thermal bridge break air-conditioner tank, comprising a framework and a wall panel, wherein the framework is assembled from three-ways connectors, rims, and a middle beam assembly, the three-ways connectors and the rims being plastically integrally formed structures; a thermal bridge break structure made of a PVC material is connected to outer sides of the three-ways connectors and the rims; the framework is formed as a cubic structure; the wall panel is assembled from a panel and a plurality of external sheet metal parts, and the wall panel is disposed in the framework by shape-fitting. The air-conditioner tank according to the present invention has a good thermal bridge break performance, and meanwhile simplifies the assembling and connecting between components.

19 Claims, 15 Drawing Sheets

(56) References Cited

U.S. PATENT DOCUMENTS

Figure 1:
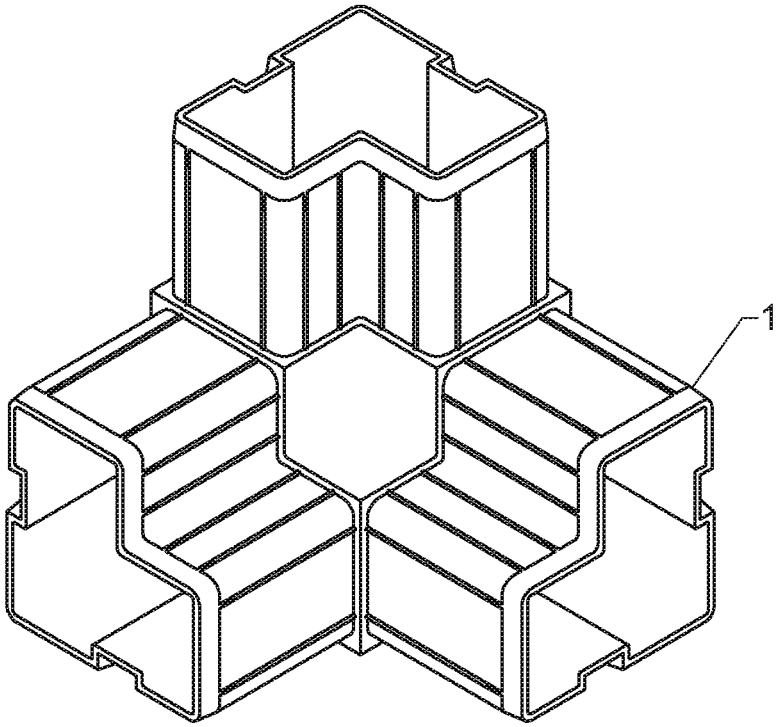

| | | | | |
|---|---|---|---|---|
| 6,067,760 | A * | 5/2000 | Nowell | E06B 3/26347 403/231 |
| 6,223,917 | B1 * | 5/2001 | Bruder | A47B 47/0008 211/189 |
| 6,350,000 | B1 * | 2/2002 | Van Benthem | E04H 1/1238 312/236 |
| 6,676,234 | B2 * | 1/2004 | Herbeck | E04C 2/292 312/236 |
| 6,820,952 | B2 * | 11/2004 | Austin | F24F 3/0442 312/265.1 |
| 7,896,177 | B1 * | 3/2011 | Toma | A47B 47/0008 108/147.17 |
| 8,047,467 | B2 * | 11/2011 | Erickson | B64D 11/0015 244/118.1 |
| 8,621,877 | B2 * | 1/2014 | Tuszkiewicz | A47F 3/0426 62/259.1 |
| 9,549,482 | B2 * | 1/2017 | Podemski | H05K 7/02 |
| 2004/0232145 | A1 * | 11/2004 | Antal, Sr. | B65D 11/1873 220/4.33 |
| 2007/0052333 | A1 * | 3/2007 | Freire | A47B 47/005 312/265.4 |
| 2008/0272677 | A1 * | 11/2008 | Francisquini | H02B 1/301 312/257.1 |
| 2013/0069501 | A1 * | 3/2013 | Liu | H05K 7/18 312/223.1 |
| 2017/0343233 | A1 * | 11/2017 | Ling | F24F 13/0263 |
| 2018/0066688 | A1 * | 3/2018 | Koepke | F16B 7/0413 |

* cited by examiner

THERMAL BREAK AIR-CONDITIONER TANK

CROSS REFERENCE TO RELATED APPLICATION

This application claims priority to and the benefit of Chinese Application No. 201620519850.7, filed May 31, 2016, entitled "THERMAL BRIDGE BREAK AIR-CONDITIONER TANK," which is incorporated by reference herein in its entirety.

FIELD OF THE INVENTION

The present invention generally relates to an air-conditioning apparatus, and more particularly to a thermal bridge break air-conditioner tank.

BACKGROUND OF THE INVENTION

An air-conditioner tank delivers treated cold or warm air over a long distance to respective air-conditioned spaces through a high static pressure fan or a high air volume fan. Due to the large size of tank and the large temperature difference between inside and outside the tank, there are thorny issues in terms of tank structure strength, noise insulation, anti-condensation, sheet metal manufacturing, and assembly of the tank, etc.

In the prior art, an air-conditioner tank usually employs an aluminum alloy framework structure, i.e., employing a rim integrally formed by an aluminum profile. The rim also functions to fix a foamed panel and internal parts. Because the aluminum profile has a good heat conductivity, cold energy inside the tank is easily conducted to an outer wall of the aluminum profile through the aluminum profile itself, causing leakage of cold energy. Meanwhile, due to a large and complex cross-section of rims of the aluminum profile, the manufacturing cost is high. Rims are usually connected via a coupling piece that is easily deformable, which will influence the perpendicularity and parallelism of a body framework and will further cause uneven interstices between the body framework and the foamed panel tank, making it difficult to assemble.

Further, in the prior art, the foamed panel of the air-conditioner tank is secured using aluminum strips and adhesive tapes, such that the tank as a whole cannot bear a heavy load and the installation is cumbersome; moreover, because the interstices between panels are decorated by trim strips, the appearance of the whole tank is unpleasing.

SUMMARY OF THE INVENTION

The present invention provides a thermal bridge break air-conditioner tank to at least partially solve the above problems existing in the prior art.

According to a first aspect of the present invention, there is provided a thermal bridge break air-conditioner tank, comprising a framework and a wall panel, wherein the framework is assembled from three-ways connectors, rims, and a middle beam assembly, the three-ways connectors and the rims being plastically integrally formed structures; a thermal bridge break structure made of a PVC material is connected to outer sides of the three-ways connectors and the rims; the framework is formed as a cubic structure; the wall panel is assembled from a panel and a plurality of external sheet metal parts, and the wall panel is fitted in the framework by shape-fitting.

According to the present invention, the connector is designed as three-ways connector integrally formed by a high strength plastic material; by interference fitting the three-ways connector and the rim profiles, a thermal bridge break is achieved, and the body framework assembled from the three-ways connector and the rim profiles has a better rigidity and a small deformation.

Optionally, the three-ways connectors and the rims are interference fitted by convex ribs.

Optionally, the three-ways connectors and the rims are interference fitted by a plurality of protrusion parts that are provided on the three-ways connector.

Optionally, the rim includes an inner aluminum alloy framework and an outer thermal bridge break structure, the thermal bridge break structure being snap-fitted to the aluminum alloy framework.

Optionally, the snap-fit is a dovetail structure or a hook-shaped structure.

Optionally, the rim is formed as a stepped structure, and the wall panel is formed as a stepped panel shape-fitting with the stepped structure.

Optionally, the stepped panel includes a convex portion at a center and a quadrangular convex ring at a periphery, the convex ring being fit with the stepped structure of the rim.

Optionally, the middle beam assembly comprises a middle beam connector and a middle profile interference-fitted with the middle beam connector, wherein the middle beam connector being secured to the rim via a built-in fastener.

BRIEF DESCRIPTION OF THE ACCOMPANYING DRAWINGS

Figure 2:
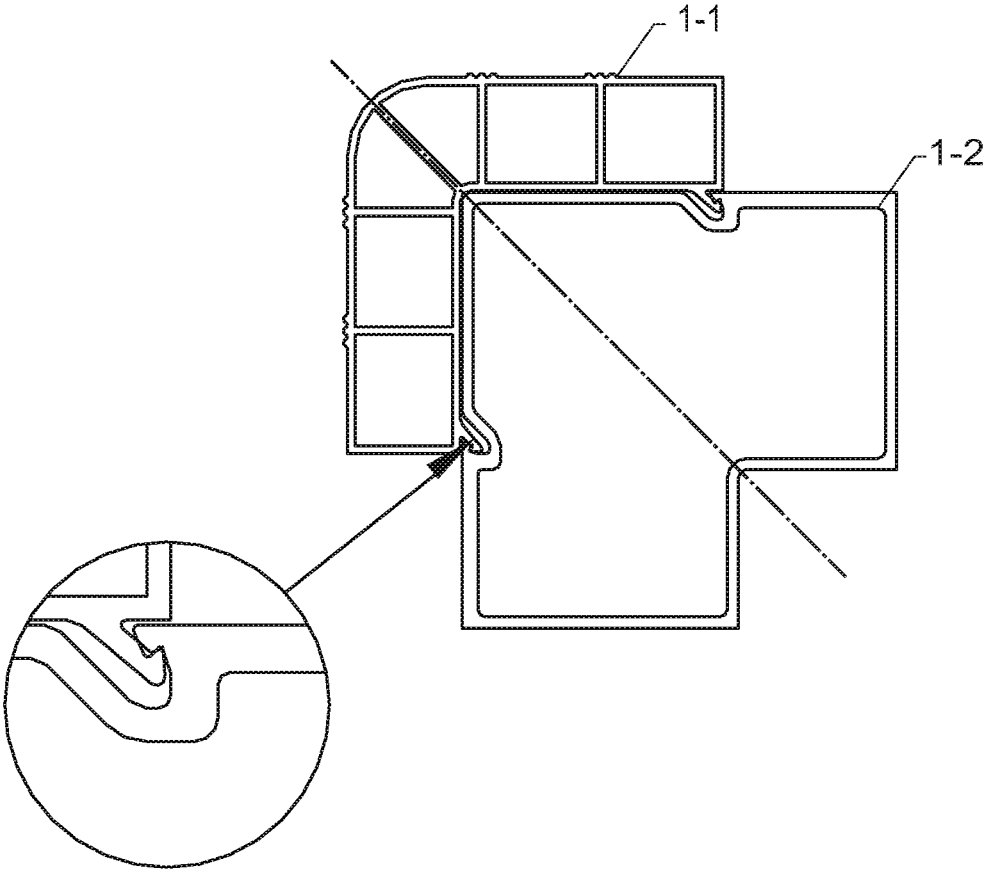
Figure 3:
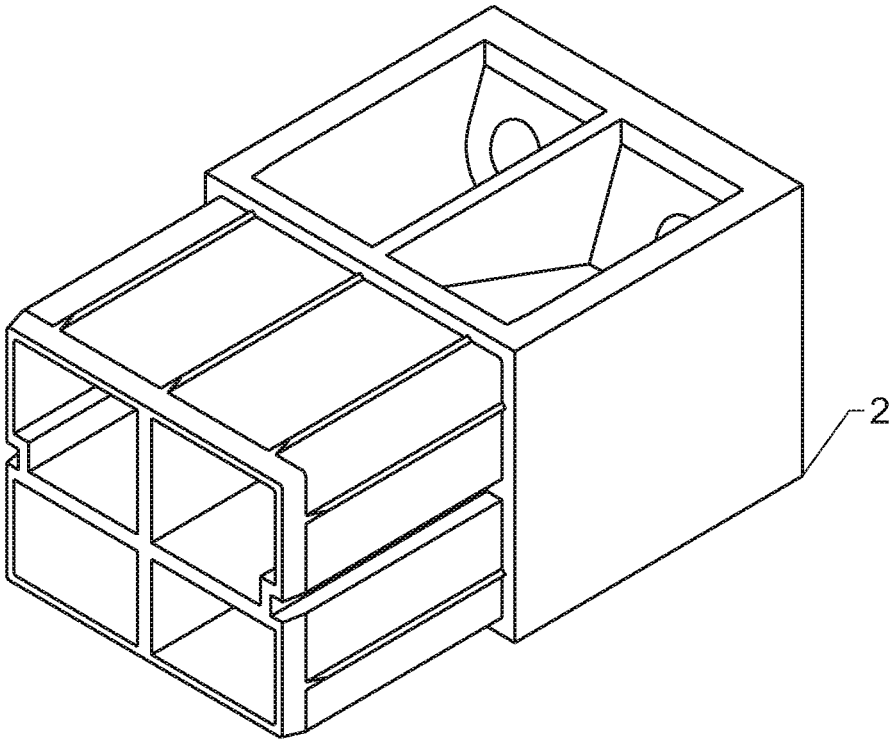
Figure 4:
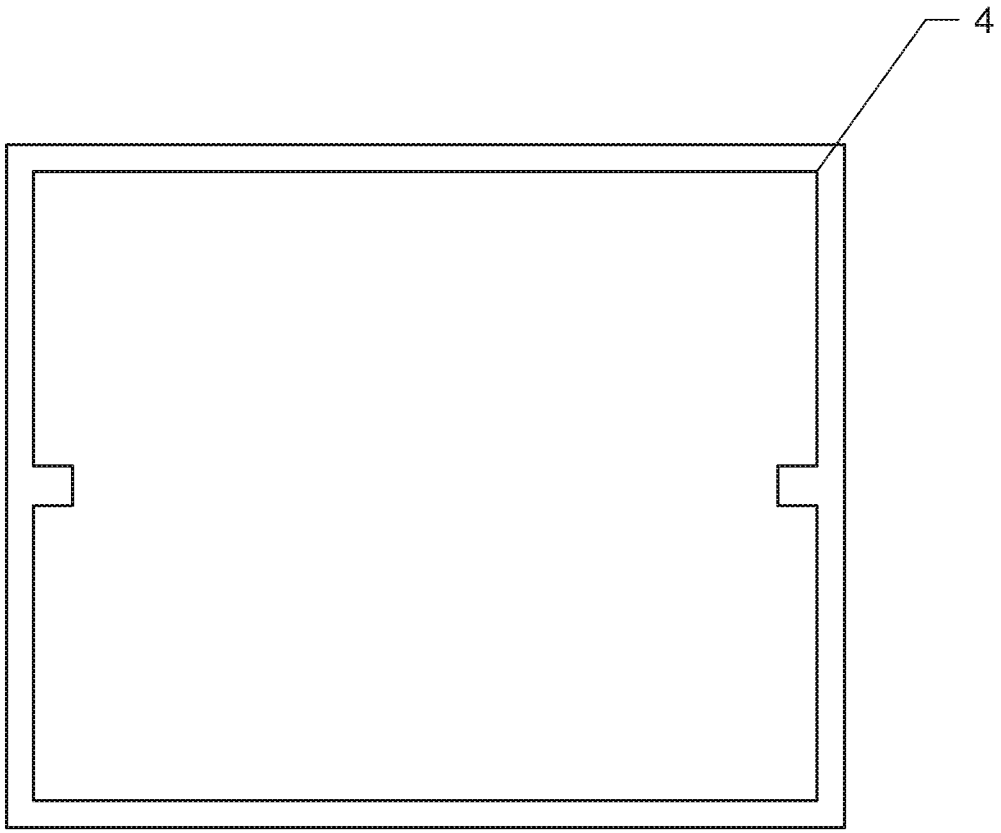
Figure 5:
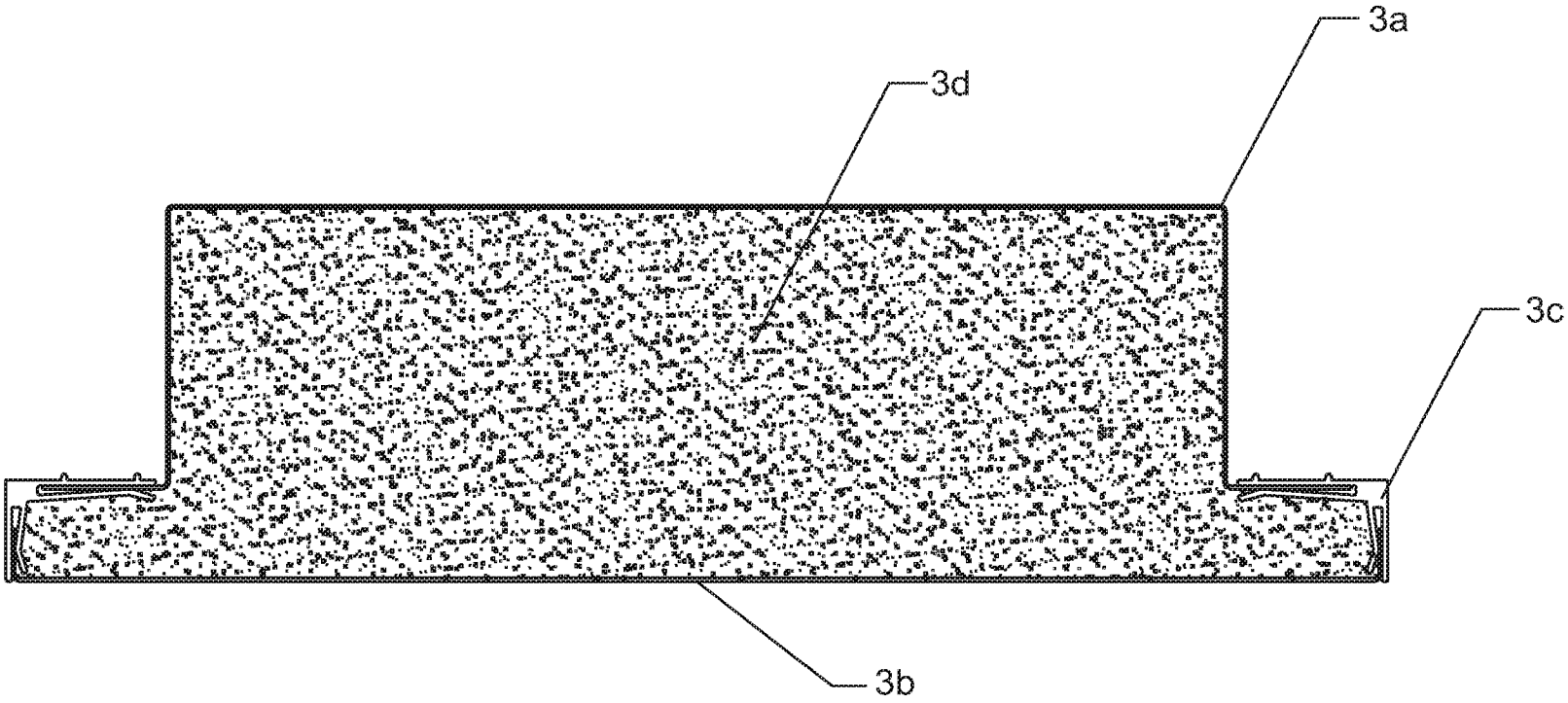
Figure 6:
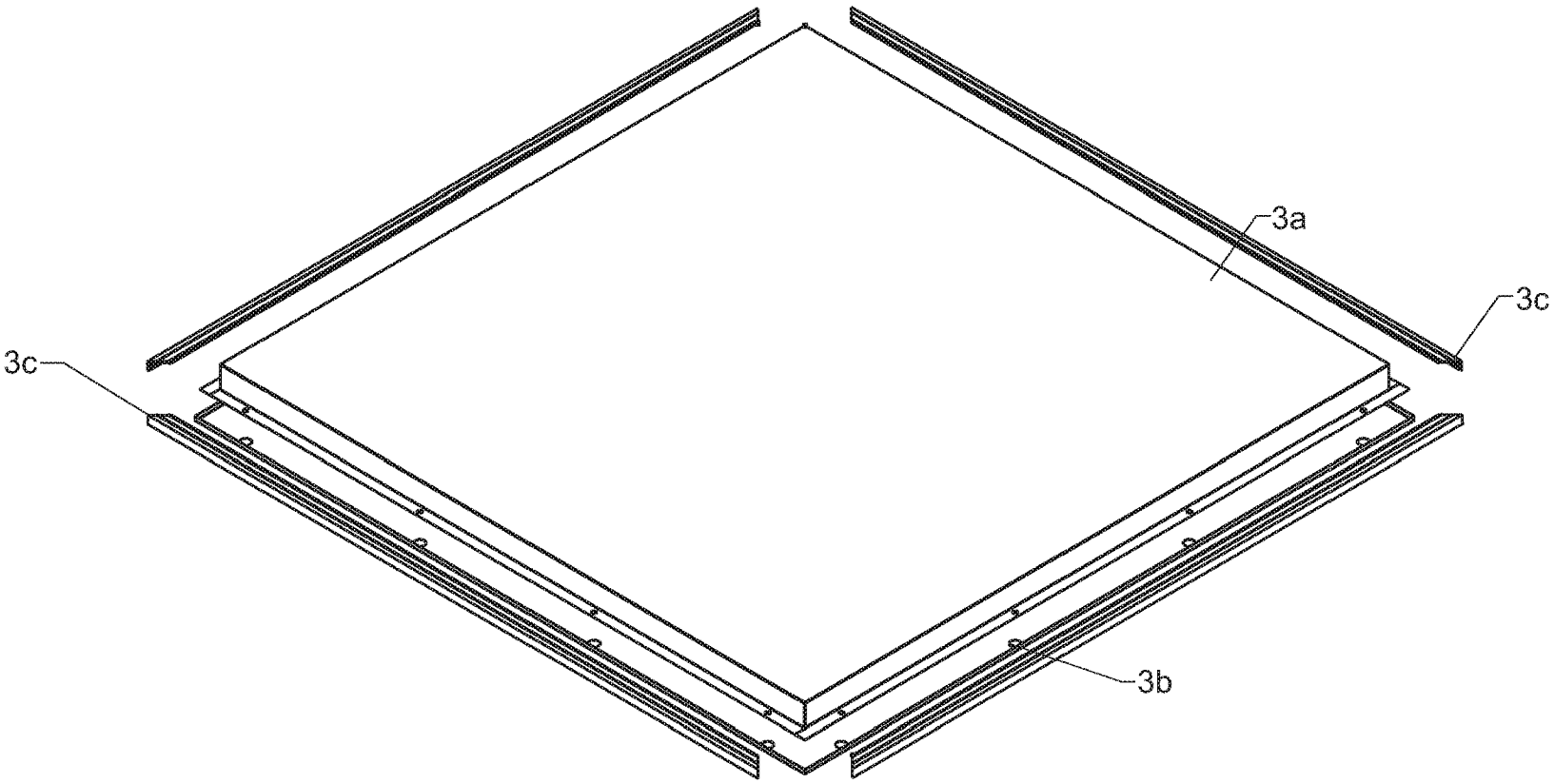
Figure 7:
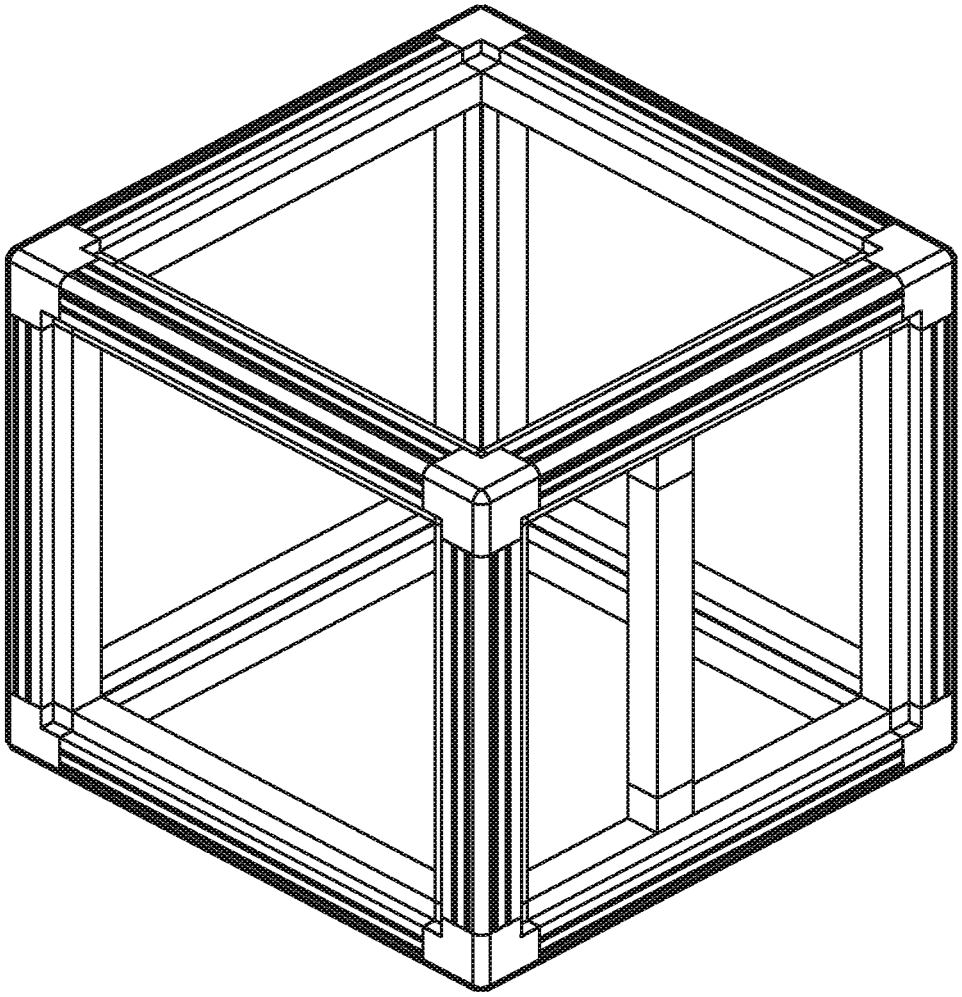
Figure 8:
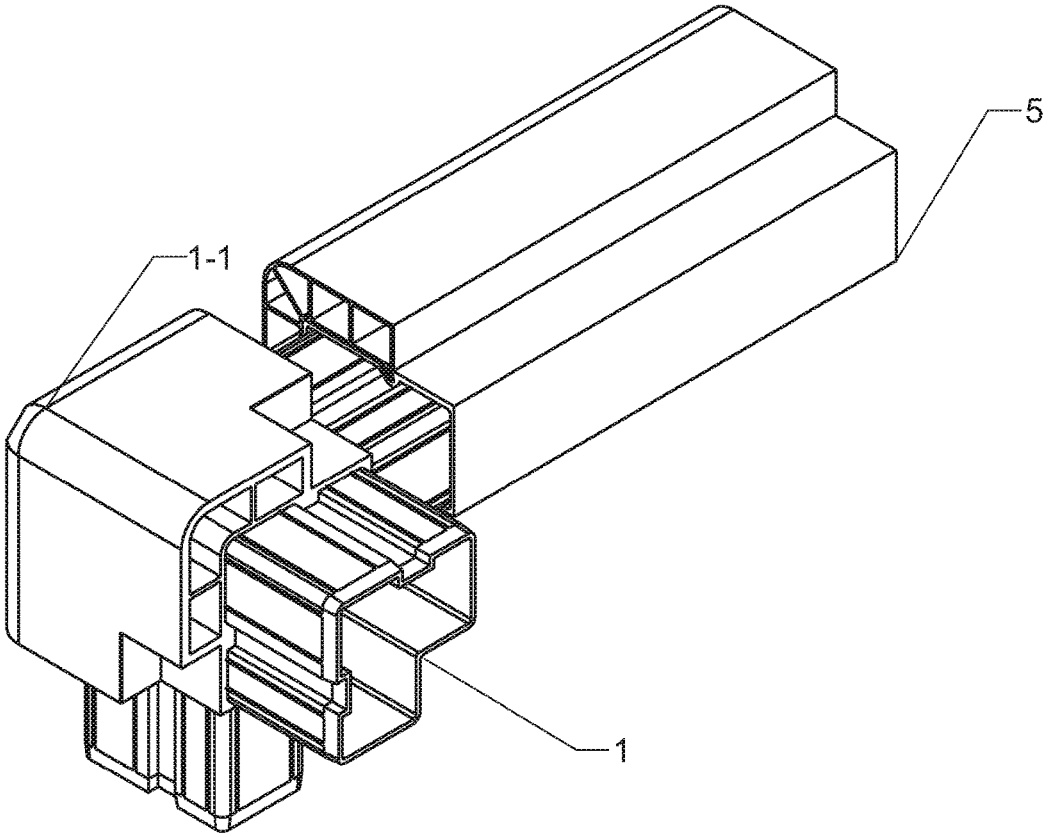
Figure 9:
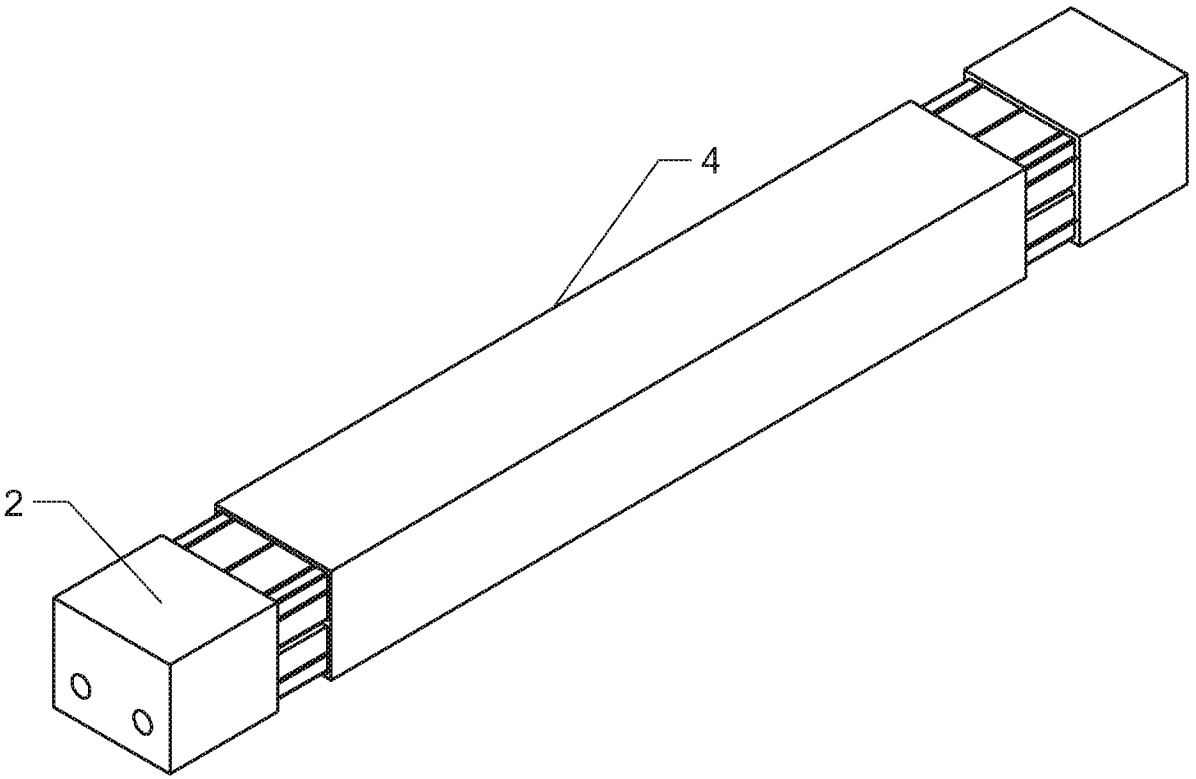
Figure 10:
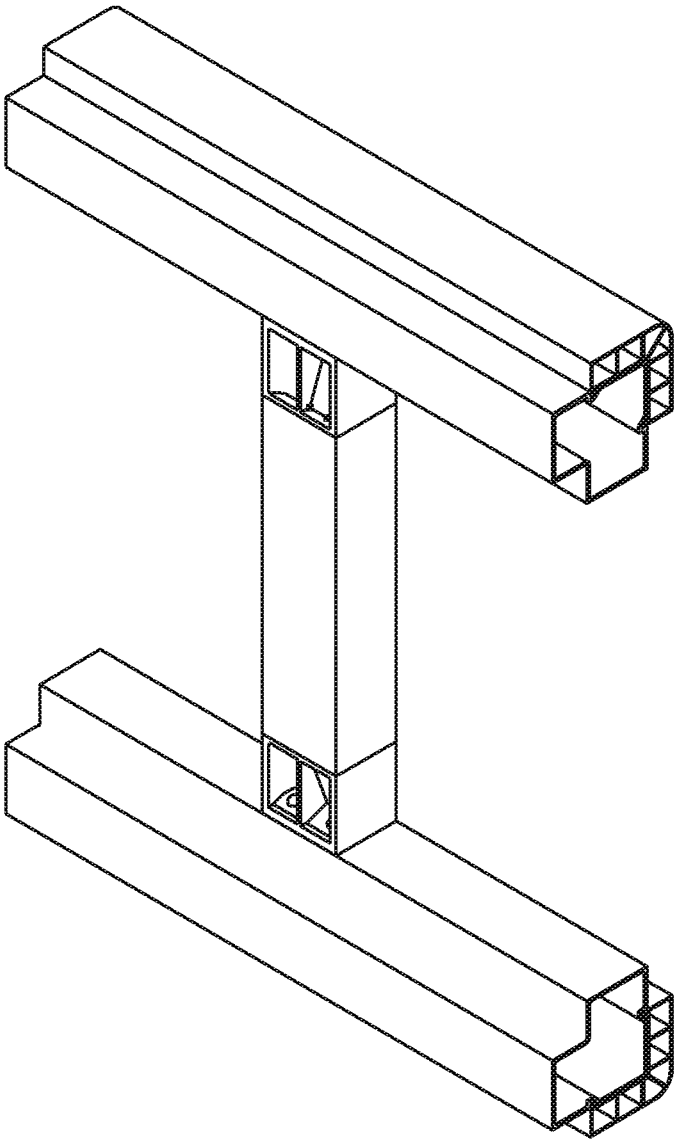
Figure 11:
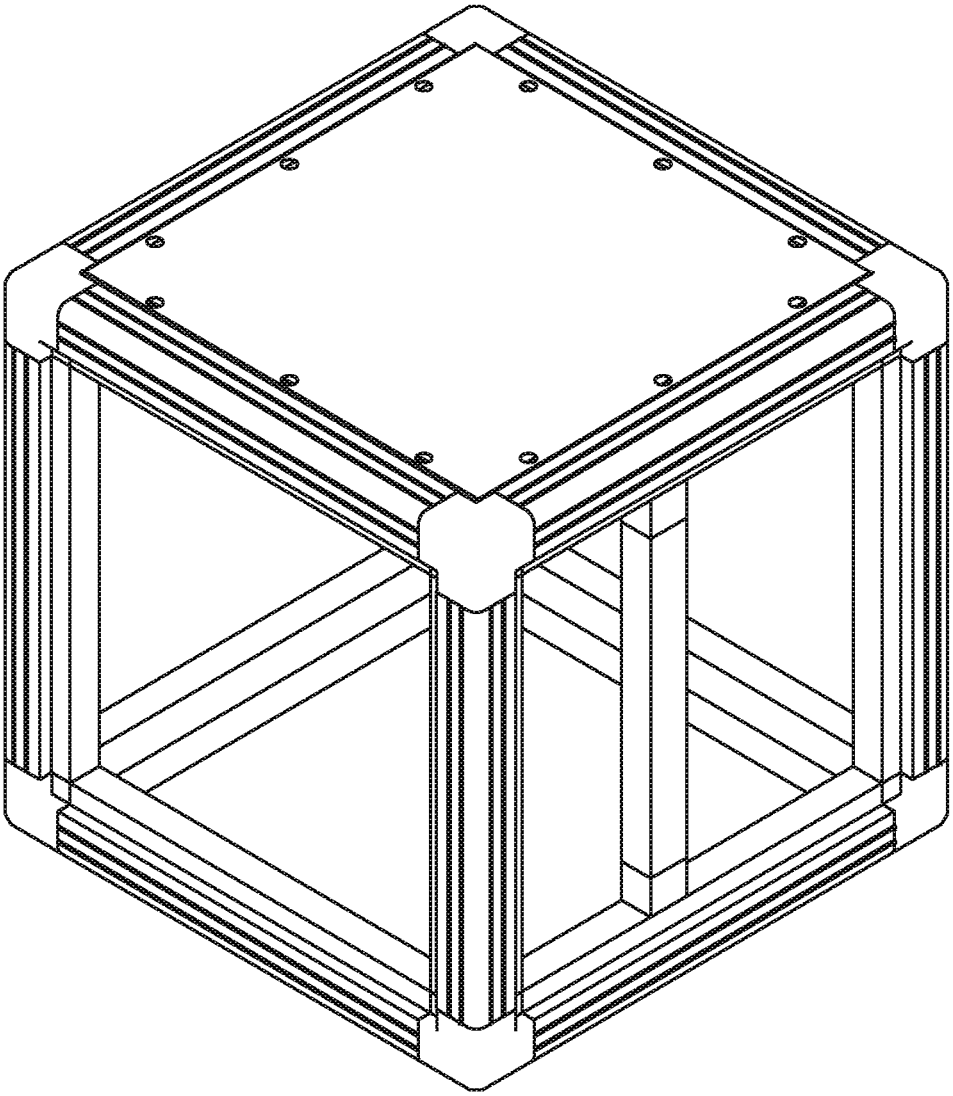
Figure 12:
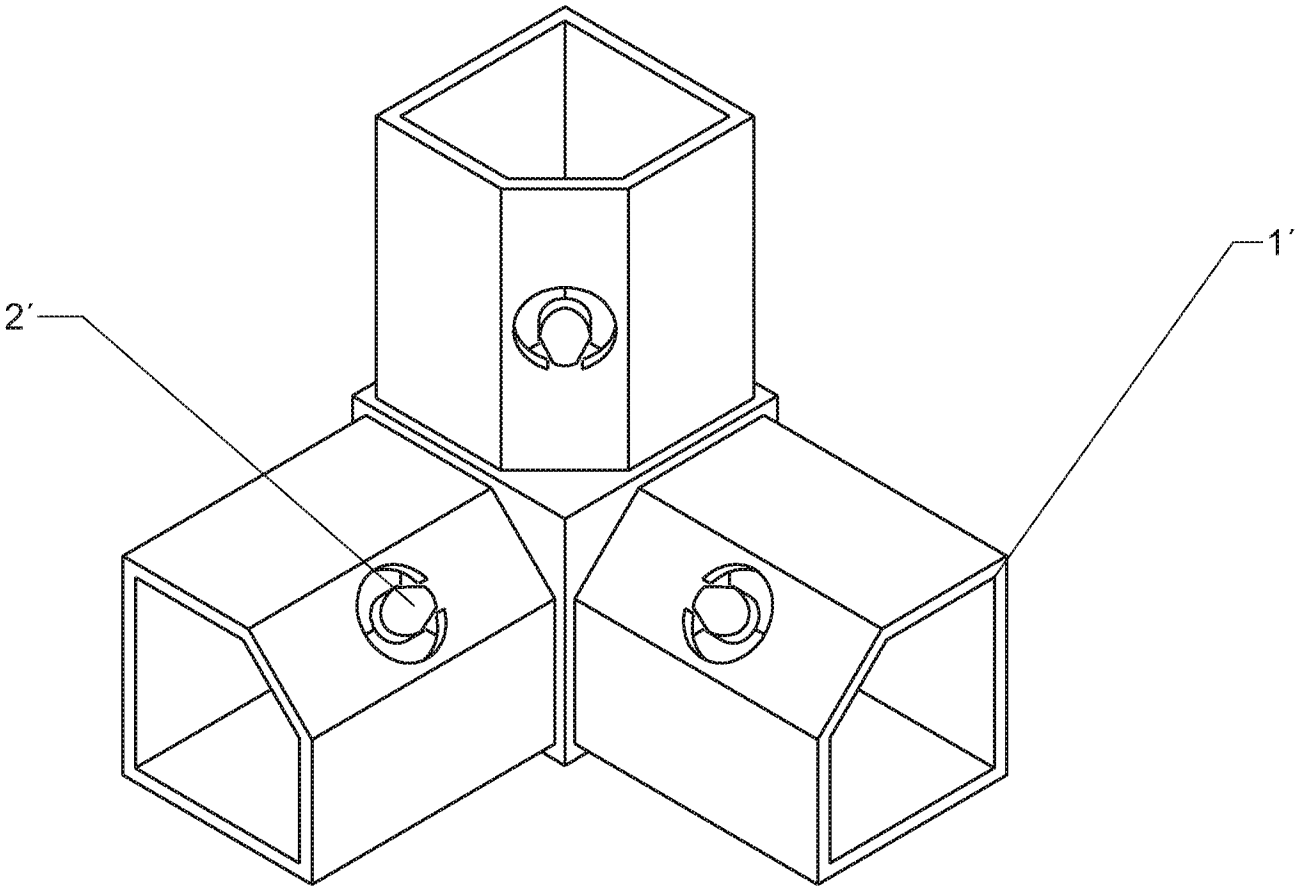
Figure 13:
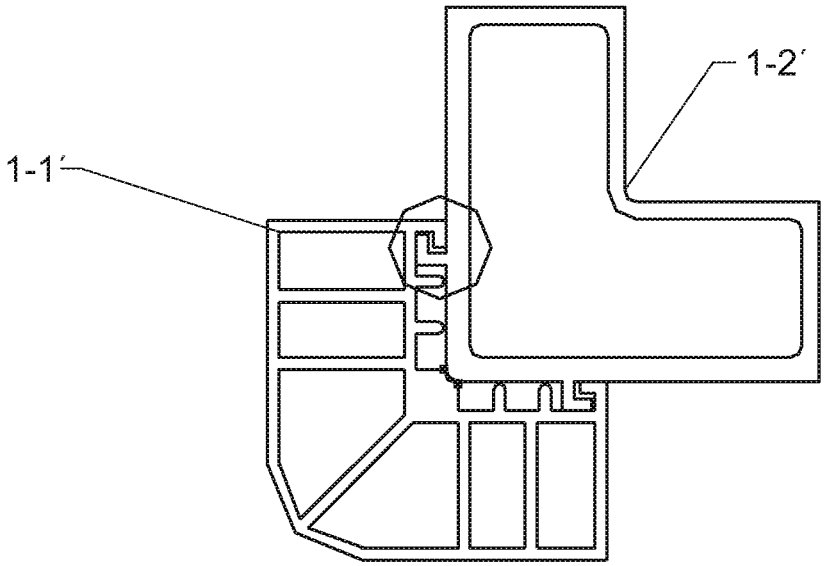
Figure 14:
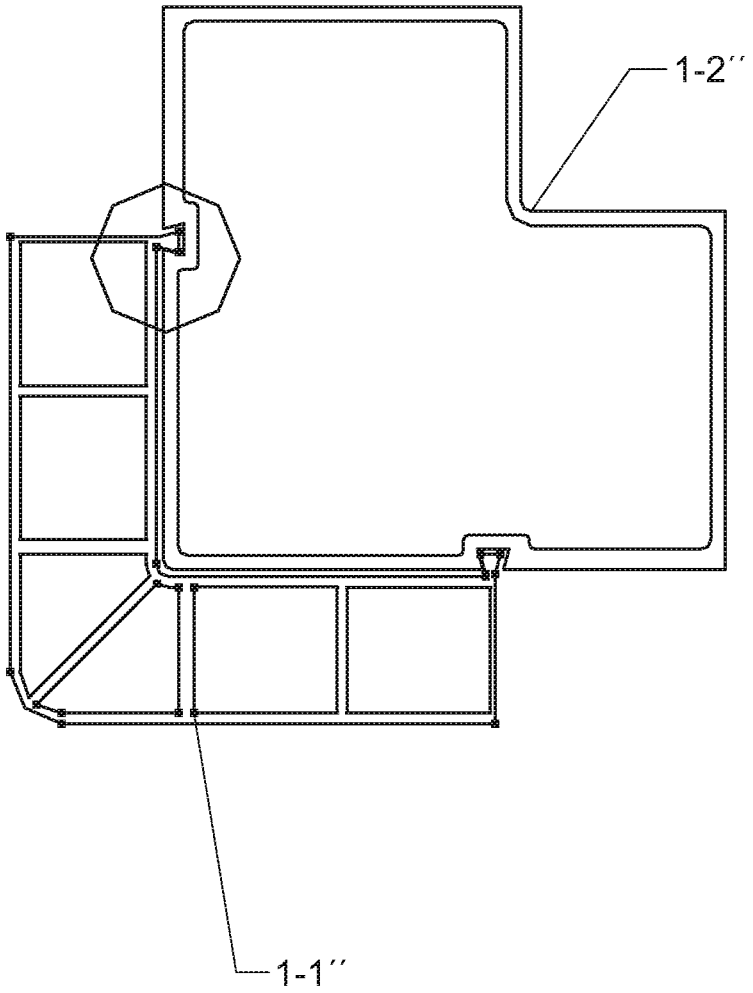
Figure 15:
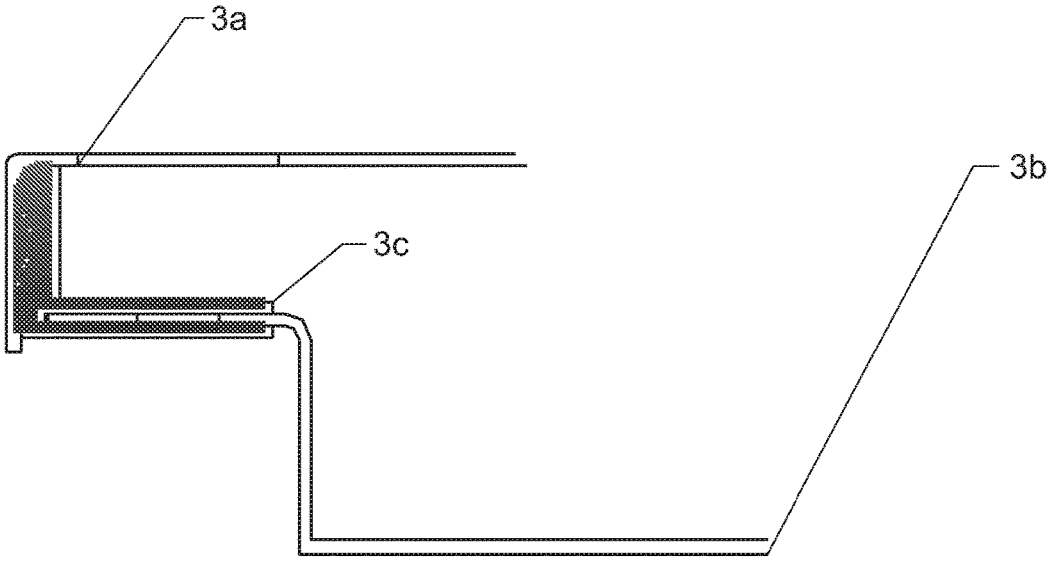

The above and other aspects of the present invention will become more apparent and easier to understand from the following description of the exemplary embodiments of the present invention in conjunction with the accompanying drawings. In the accompanying drawings:

FIG. 1 schematically illustrates an embodiment of a three-ways connector of the present invention;

FIG. 2 schematically illustrates a thermal bridge break and a rim of the present invention;

FIG. 3 schematically illustrates a middle beam connector of the present invention;

FIG. 4 schematically illustrates a middle beam profile of the present invention;

FIG. 5 schematically illustrates a sectional view of a foamed panel of the present invention;

FIG. 6 schematically illustrates an exploded view of a foamed panel of the present invention;

FIG. 7 schematically illustrates a schematic diagram of a tank framework of the present invention;

FIG. 8 schematically illustrates a diagram of assembling a three-ways connector and rims of the present invention;

FIG. 9 schematically illustrates a diagram of assembling a middle beam connector and a middle beam of the present invention;

FIG. 10 schematically illustrates a diagram of assembling a rim and a middle beam of the present invention;

FIG. 11 schematically illustrates a diagram of assembling a panel and a framework of the present invention;

FIG. 12 schematically illustrates another embodiment of a three-ways connector of the present invention;

FIG. 13 schematically illustrates a further embodiment of a thermal bridge break and a rim of the present invention;

FIG. 14 schematically illustrates a still further embodiment of a thermal bridge break and a rim of the present invention;

FIG. 15 schematically illustrates another embodiment of a foamed panel.

NOTES OF REFERENCE NUMERALS

1, 1'. Three-ways connector 2. Middle beam connector 3. Foamed panel 4. Middle beam profile 1-1. Thermal bridge break 1-2. Aluminum alloy framework 3*a*. Outer panel 3*b*. Inner panel 3*c*. Frame strip 3*d*. PU 2'. Protrusion part

DETAILED DESCRIPTION OF THE PREFERRED EMBODIMENTS

Hereinafter, the preferred embodiments of the present invention will be illustrated with reference to the accompanying drawings. It needs to be noted that the terms "up," "down," "front," "rear," "left," "right" and similar expressions used herein are only for illustrative purposes, not for limiting.

FIG. 1 illustrates a plastic three-ways connector 1 of the present invention, wherein the connector 1 for example may be injection molded with PA66 doping with 10% glass fiber. As shown in the figure, the three-ways connector 1 is a hollow body having protrusions formed in three axial directions of X, Y, and Z, respectively, wherein the protrusions are preferably convex ribs having a width of 1.0 mm and a height of 0.4 mm, and a side of the respective convex rib is formed as an L-shape matching with the cross-section of the rim profile. With the convex ribs, the three-ways connector 1 is more easily interference-fitted with the rim profile.

FIG. 2 shows a thermal bridge break aluminum alloy rim profile according to the present invention. The rim profile comprises an external thermal bridge break 1-1 made of a PVC material and an internal aluminum alloy rim 1-2. Preferably, these two parts are both formed by an extrusion process. A recessed groove is provided on an outer side edge of the aluminum alloy framework 1-2; a hook-shaped piece is provided on a corresponding position at an inner side of the thermal bridge break 1-1, wherein the thermal bridge break 1-1 is shape-fitting with the aluminum alloy framework 1-2 by the hook-shaped piece.

FIGS. 3-4 illustrate a middle beam connector 2 and a middle beam profile 4 according to the present invention, wherein the middle beam connector 2 is preferably made of a plastic material, one end of the middle beam connector 2 has a side mounting space for being connected to the framework structure; preferably, the middle beam connector 2 is secured to the framework by a built-in fastener, and the other end of the middle beam connector 2 has a protrusion extending along an axial direction, wherein the protrusion is preferably a protrusion having a width of 1.0 mm and a height of 0.4 mm; a side face of the protrusion forms a rectangle matching with a rectangular cross section of the middle beam profile 4; by means of the protrusion, the middle beam connector 2 is more easily interference-fitted with the middle beam profile 4. The middle beam profile 4 is preferably a rectangular middle beam formed by an aluminum alloy through an extrusion process.

FIGS. 5-6 show a foamed panel 3 according to the present invention. As shown in the figure, the foamed panel 3 is preferably a PU (Polyurethane) foamed panel. The panel includes a closed body comprising an outer panel 3*a* preferably made of a sheet metal part, an inner panel 3*b* preferably made of a sheet metal part, and a PVC frame strip 3*c* that connects the inner panel and the outer panel. After the PU 3*d* of a predetermined density is injected in the closed body, a complete PU foamed panel 3 is formed. As shown in FIG. 5, the PVC frame strip 3*c* forms a stepped portion at a side face of the panel, and the foamed panel 3 may be assembled to the framework using the stepped portion. Because the panel adopts a stepped portion design, a complete quadrilateral convex ring is formed at a periphery of the panel, thereby effectively compressing the sealing strip adhered to the rim profile and the middle beam profile, thereby enhancing the sealing performance of the tank.

FIG. 7 illustrates a thermal bridge break air-conditioner tank according to the present invention, wherein the tank comprises a framework and a wall panel (not shown in the figure), wherein the framework is assembled from three-ways connectors 1, rims, and a middle beam assembly, the three-ways connectors 1 and the rims being plastically integrally formed structures; a thermal bridge break structure 1-1 made of a PVC material is connected to outer sides of the three-ways connectors and the rims; the framework is formed as a cubic structure; the wall panel is a foamed panel 3 assembled from a panel and a plurality of external sheet metal parts, and the wall panel is fitted in the framework by shape-fitting. Specifically, the rim is formed as a stepped structure, and the wall panel is formed as a stepped panel shape-fitting with the stepped structure. Particularly, the middle beam assembly is assembled from a middle beam profile 4 and a middle beam connector 2 disposed at two ends of the middle beam profile 4 and is connected to the rim of the framework by means of a built-in fastener disposed on the middle beam connector 2.

FIGS. 8-11 illustrate a process of assembling a framework of a thermal bridge break air-conditioner tank according to the present invention. As illustrated in FIG. 8, the three-ways connector 1 and the rim profile are first assembled. Specifically, by inserting the axial protrusion of the three-ways connector 1 into the inner cavity of the rim profile, an interference fitting is achieved therebetween; by connections on a plurality of edge corners, the body framework of the air-conditioner tank will be completed after the insertion is completed; during the assembly process, it is not necessary to use a fastener such as a rivet. Further, a plurality of thermal bridge breaks 1-1 made of PVC materials are laid at the outer side of the connected three-ways connector 1 and rims by snap-fit, e.g., a hook-shaped structure, thereby guaranteeing a thermal insulation effect of the framework.

After the connection between the three-ways connector 1 and the rim profile is completed, as shown in FIG. 9, the middle beam connector 2 and the middle beam profile 4 are connected. Specifically, the middle beam connector 2 is inserted into an inner cavity of the middle beam profile 4; the secured connection between the middle beam connector 2 and the middle beam profile 4 is implemented by interference fitting the protrusion of the middle beam connector 2 and the inner cavity of the middle beam profile 4, thereby forming the middle beam profile assembly. After the insertion is completed, as shown in FIG. 10, using a built-in fastener on the middle beam connector 2, the middle beam profile assembly may be mounted on a rim framework, preferably, but not limited to, vertically mounting the middle beam profile assembly, thereby completing the assembly of the body framework of the air-conditioner tank.

Finally, in FIG. 11, the wall panel formed by the foamed panel 3 is disposed in the framework by shape-fitting, wherein the stepped panel of the foamed panel 3 matches with the stepped structure of the rim. By engaging a plurality of faces of the framework, the tank is completely sealed, thereby completely assembling the air-conditioner tank.

FIG. 12 also illustrates a variation of the three-ways connector 1. Specifically, the three-ways connector 1' is integrally formed by a plastic material. Different from the three-ways connector 1, the three-ways connector 1' eliminates the protrusions on the axial directions of X, Y, and Z; instead, 3 raised portions 2' are provided on the axial directions of X, Y, and Z, respectively; the interference fitting between the three-ways connector 1' and the rim profile are implemented using a plurality of raised portions 2'.

FIGS. 13-14 also illustrate some variations of snap-fitting between the rim profiles inside the thermal bridge break 1-1' made of the external PVC material. As illustrated in FIG. 13, the thermal bridge break 1-1' made of the external PVC material is connected to the internal rim profile by a hook portion bent inwardly. As illustrated in FIG. 14, the thermal bridge break 1-1' made of the external PVC material is connected to the internal rim profile by a dovetail hook part.

FIG. 15 also illustrates a variation of the foamed panel 3. Specifically, instead of disposing the PVC frame strip 3*c* of the foamed panel 3 outside of the outer panel 3*a* as shown in FIG. 5, in this variation, the PVC frame stripe 3*c* is disposed inside the outer panel 3*a*, thereby avoiding degradation of the PVC frame strip 3*c* under the influence of external environment.

The present invention has been described through the embodiments above. However, it should be understood that the embodiments above are only for exemplary and illustrative purposes, not intended to limit the present invention within the scope of the embodiments as described. Besides, those skilled in the art may understand that the present invention is not limited to the embodiments above; more variations and modifications may also be made according to the teaching of the present invention. All of these variations and modifications fall within the scope of protection of the present invention.

We claim:

1. A thermal break air-conditioner unit housing, comprising:

a framework assembled from three-way connectors, rims, and a middle beam assembly, wherein the framework is formed as a cubic structure, wherein each rim comprises an aluminum alloy framework and a thermal break structure receiving feature defined in an outer surface of the aluminum alloy framework, and wherein the three-way connectors and the rims comprise respective unitary structures;

a thermal break structure comprising a PVC material, wherein the thermal break structure is connected to outer sides of the three-way connectors and the rims, wherein the thermal break structure comprises a retaining feature that is snap-fit into the thermal break structure receiving feature of the aluminum alloy framework, and wherein the thermal break structure is raised relative to the outer sides of the three-way connectors and the rims to enable the thermal break structure to contact a surface and to prevent the three-way connectors and the rims from contacting the surface; and a wall panel assembled from a panel and a plurality of external sheet metal parts, wherein the wall panel is interference fitted into the framework.

2. The air-conditioner unit housing of claim 1, wherein each three-way connector comprises a plurality of protrusion parts extending from a center portion, and wherein each of the three-way connectors and the rims are interference fitted by the respective plurality of protrusion parts of each three-way connector engaging corresponding inner perimeters of hollows in the rims.

3. The air-conditioner unit housing of claim 1, wherein the retaining feature of the thermal break structure comprises a dovetail structure or a hook-shaped structure.

4. The air-conditioner unit housing of claim 1, wherein each rim comprises a panel-receiving recess that is defined along a respective length of each of the rims and that has a rim geometry, and wherein an edge of the wall panel comprises a panel geometry that corresponds to the rim geometry of the panel-receiving recess of each of the rims.

5. The air-conditioner unit housing of claim 4, wherein the wall panel includes an insulating portion at a center portion of the wall panel and a quadrangular ring at a periphery of the wall panel, wherein the quadrangular ring comprises the panel geometry that corresponds to the panel-receiving recess of the rim.

6. The air-conditioner unit housing of claim 1, wherein the middle beam assembly comprises a middle beam connector and a middle beam element interference fitted with the middle beam connector, wherein the middle beam connector comprises a fastener-receiving receptacle extending from a first surface of the middle beam connector to a second surface of the middle beam connector, and wherein the middle beam connector is secured to one of the rims via a fastener disposed between the fastener-receiving receptacle and the one of the rims.

7. The air-conditioner unit housing of claim 1, wherein the unitary structure of the three-way connector is injection molded.

8. The air-conditioner unit housing of claim 1, wherein the thermal break structure receiving feature of the aluminum alloy framework comprises a receptacle, and wherein the retaining feature of the thermal break structure comprises a dovetail structure or a hook-shaped structure.

9. A thermal break air-conditioner unit housing, comprising:

a plurality of three-way connectors disposed at corner portions of a framework, wherein each three-way connector of the plurality of three-way connectors comprises a unitary connector structure having a center portion and three protrusion parts, each protrusion part extending along a respective axial direction from the center portion;

a plurality of rims, wherein each rim of the plurality of rims comprises a unitary rim structure having a first end portion configured to be interference fitted over a first protrusion part of a first three-way connector of the plurality of three-way connectors and having a second end portion configured to be interference fitted over a second protrusion part of a second three-way connector of the plurality of three-way connectors to define edges of the framework;

a connector thermal break structure coupled to an outer surface of one three-way connector of the plurality of three-way connectors and comprising a PVC material, wherein the connector thermal break structure is raised relative to the outer surface of the one three-way connector to enable contact between the connector thermal break structure and a surface and to prevent contact between the one three-way connector and the surface; and a rim thermal break structure coupled to an outer surface of one rim of the plurality of rims and comprising the PVC material, wherein the rim thermal break structure is raised relative to the outer surface of the one rim to enable contact between the rim thermal break structure and the surface and to prevent contact between the one rim and the surface.

10. The air-conditioner unit housing of claim 9, comprising a wall panel configured to be interference fitted within a side opening defined in a center portion of one side of the framework, wherein the wall panel comprises an outer sheet metal panel, an inner sheet metal panel, polyurethane foam disposed between the outer sheet metal panel and the inner sheet metal panel, and a frame strip joining a perimeter of the outer sheet metal panel to a perimeter of the inner sheet metal panel.

11. The air-conditioner unit housing of claim 10, wherein the outer sheet metal panel is configured to be flush with an outermost surface of the rims surrounding the side opening, and wherein the frame strip is configured to be received within an L-shaped recess defined along a length of each rim of the plurality of rims surrounding the side opening.

12. The air-conditioner unit housing of claim 9, comprising a middle beam assembly extending between two opposing rims of the plurality of rims, wherein the middle beam assembly comprises:

a first middle beam connector coupled to a first opposing rim of the two opposing rims via a first fastener extending between a first receptacle of the first middle beam connector and the first opposing rim;

a second middle beam connector coupled to a second opposing rim of the two opposing rims via a second fastener extending between a second receptacle of the second middle beam connector and the second opposing rim; and a middle beam element configured to be interference fitted between the first middle beam connector and the second middle beam connector.

13. A thermal break air-conditioner unit housing, comprising:

a framework assembled from three-way connectors, rims, and a middle beam assembly, wherein the framework is formed as a cubic structure, and wherein the three-way connectors and the rims comprise respective unitary structures;

a thermal break structure comprising a PVC material, wherein the thermal break structure is connected to outer sides of the three-way connectors and the rims, wherein the thermal break structure is raised relative to the outer sides of the three-way connectors and the rims to enable the thermal break structure to contact a surface and to prevent the three-way connectors and the rims from contacting the surface, wherein the thermal break structure connected to the rims comprises ribs formed in an outer surface of the thermal break structure, wherein the rims each comprise a corresponding recessed groove extending into an outer surface of the rims, and wherein the thermal break structure and the rims are interference fitted by contact between the ribs of the thermal break structure and the corresponding recessed grooves of the rims; and a wall panel assembled from a panel and a plurality of external sheet metal parts, wherein the wall panel is interference fitted into the framework.

14. The air-conditioner unit housing of claim 13, wherein each three-way connector comprises a plurality of protrusion parts extending from a center portion, and wherein the three-way connectors and the rims are interference fitted by the respective plurality of protrusion parts of each three-way connector.

15. The air-conditioner unit housing of claim 13, wherein each rim comprises a panel-receiving recess defined along a length of the rim and having a rim geometry, and wherein an edge of the wall panel comprises a panel geometry that corresponds to the rim geometry of the panel-receiving recess of the rim.

16. The air-conditioner unit housing of claim 15, wherein the wall panel includes an insulating portion at a center portion of the wall panel and a quadrangular ring at a periphery of the wall panel, wherein the quadrangular ring comprises the panel geometry that corresponds to the panel-receiving recess of the rim.

17. The air-conditioner unit housing of claim 13, wherein the middle beam assembly comprises a middle beam connector and a middle beam element interference fitted with the middle beam connector, wherein the middle beam connector comprises a fastener-receiving receptacle extending from a first surface of the middle beam connector to a second surface of the middle beam connector, and wherein the middle beam connector is secured to one of the rims via a fastener disposed between the fastener-receiving receptacle and the one of the rims.

18. The air-conditioner unit housing of claim 13, wherein the unitary structure of the three-way connector is injection molded.

19. The air-conditioner unit housing of claim 13, wherein the framework formed as the cubic structure comprises a rectangular wireframe.

* * * * *